US009604277B2

(12) United States Patent
Zhou et al.

(10) Patent No.: US 9,604,277 B2
(45) Date of Patent: Mar. 28, 2017

(54) INTEGRATED MOULD FOR LOW-PRESSURE CASTING OF WHEELS

(71) Applicant: CITIC Dicastal CO., LTD, Qinhuangdao (CN)

(72) Inventors: Peng Zhou, Qinhuangdao (CN); Yongning Wang, Qinhuangdao (CN); Zhihua Zhu, Qinhuangdao (CN); Changhai Li, Qinhuangdao (CN); Hongbiao Li, Qinhuangdao (CN); Xiwei Xue, Qinhuangdao (CN); Yong Li, Qinhuangdao (CN); Gui Wang, Qinhuangdao (CN); Longtao Kang, Qinhuangdao (CN); Donghui Zhang, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 0 days.

(21) Appl. No.: 15/184,052

(22) Filed: Jun. 16, 2016

(65) Prior Publication Data

US 2016/0368043 A1 Dec. 22, 2016

(30) Foreign Application Priority Data

Jun. 16, 2015 (CN) ..... 2015 1 0330654

(51) Int. Cl.

| | |
|---|---|
| ***B22C 9/28*** | (2006.01) |
| ***B22C 9/06*** | (2006.01) |
| ***B22D 18/04*** | (2006.01) |

(52) U.S. Cl.
CPC ..... *B22C 9/28* (2013.01); *B22C 9/06* (2013.01); *B22D 18/04* (2013.01)

(58) Field of Classification Search
CPC ..... B22C 9/28; B22D 18/04
See application file for complete search history.

(56) References Cited

U.S. PATENT DOCUMENTS

| | | | | |
|---|---|---|---|---|
| 4,117,878 A * | 10/1978 | Najmowicz | B22D 13/101 164/292 |
| 4,492,264 A * | 1/1985 | Gaddi | B60B 3/06 164/292 |
| 5,311,918 A * | 5/1994 | Scott | B60B 3/06 164/113 |
| 6,443,217 B1 * | 9/2002 | May | B22C 9/28 164/340 |

* cited by examiner

*Primary Examiner* — Kevin E Yoon
(74) *Attorney, Agent, or Firm* — Maier & Maier, PLLC

(57) ABSTRACT

The present invention provides an integrated mold for casting of wheels. The integrated mold has an upper mold, integrated side molds and a lower mold, wherein the number of the integrated side molds is four in the circumferential direction of the wheel mold. Thermal deformation circular arc compensation surfaces are formed by processing on an upper and lower one-fourth circular arc part of each integrated side mold, and compensation surfaces are formed by processing on key parts of 45-degree matching surfaces of the adjacent integrated side molds. The integrated side molds can effectively solve the problems such as imprecise matching of the matching surfaces, parting-line flashes of the matching surfaces and adhesion of aluminum caused by thermal deformation of the integrated side molds.

4 Claims, 3 Drawing Sheets

INTEGRATED MOULD FOR LOW-PRESSURE CASTING OF WHEELS

TECHNICAL FIELD

The present invention relates to the casting field and, in particular to an air-cooled integrated side mould for casting wheels.

BACKGROUND ART

Among technologies for manufacturing aluminum alloy wheels, low-pressure casting is a relatively mature one. Moulds (for example, side moulds) for low-pressure casting need to be cooled in the casting process of actual production. Integrated side moulds are commonly adopted in the moulds for low-pressure casting of the wheels and have relatively good effects in practical applications. As the integrated side moulds are simple and convenient to assemble and are relatively low in production cost and maintenance cost, they are widely applied in industrial production.

However, molten aluminum transfers lots of heat to the integrated side moulds in the casting process, thus causing seriously thermal deformation and regular distortion of the side moulds. The deformation and distortion have a serious influence on the precision of matching between the side moulds, between the side moulds and the lower mould and between the side moulds and the upper mould, thus causing problems such as parting-line flashes of matching surfaces and adhesion of aluminum. Since it is difficult to definitely calculate and estimate factors affecting heat expansion and cold contraction of the low-pressure cast aluminum wheels, it is difficult to overcome the dimension error of casting caused by deformation of the moulds by providing allowance in design, and biggish difficulties are also brought in the subsequent machining process.

Meanwhile, the moulds are prone to be locally worn due to the irregular thermal deformation of the moulds, and thus, the service life of the moulds is shortened. In the casting field, the cost of the mould is a very important part of the casting cost. From the point of production practice, 45-degree matching surfaces of the side moulds, i.e., matching surfaces between the side moulds and the upper mould and matching surfaces between the side moulds and the lower mould, are firstly damaged.

It is desirable in the field to overcome this problem by designing a novel mould so as to prolong the service life of the mould, reduce the cost of the mould in production, improve the dimensional accuracy of the wheel as much as possible in a casting stage and overcome the problems such as parting-line flashes and adhesion of aluminum. If this problem can be overcome, the service life of the mould can be prolonged, labor hours and consumed materials can be saved in a machining process, the manufacturing cost of the wheel can be reduced, the utilization ratio of metals can be increased, and the profitability of enterprises can be improved.

SUMMARY OF THE INVENTION

Therefore, the purpose of the present invention is to provide a novel integrated air-cooled side mould to overcome the above-mentioned problems such as parting-line flashes, adhesion of aluminum and extrusion deformation and damage of the mould.

In order to achieve the above purpose of the present invention, the present invention provides the following technical solutions:

In one aspect of the present invention, an integrated mould for low-pressure casting of wheels is provided. The integrated mould comprises an upper mould, integrated side moulds and a lower mould and is characterized in that:

thermal deformation circular arc compensation surfaces with endpoints (B), (D), (G) and (I), which pass through points (K) and (L) respectively, are formed by processing on upper and lower one-fourth circular arc matching surfaces of the integrated side moulds, i.e. on circular arc surfaces of the integrated side moulds, which are matched with side walls of the upper mould and the lower mould. On the two thermal deformation circular arc compensation surfaces, the distance from the point (K) to an original circular arc point (C) is from 0.2 mm to 0.5 mm, and the distance from the point (L) to an original circular arc point (H) is from 0.2 mm to 0.5 mm. The point (B) and the point (D) are located on an original circular arc, and the point (G), the point (I) are located on an original circular arc, and they are 60 to 80 mm apart from corresponding 45-degree matching surfaces respectively.

Compensation surfaces are formed by processing on key parts of the 45-degree matching surfaces of the adjacent integrated side moulds, wherein the 45-degree surfaces of the integrated side moulds are the matching surfaces of the four side moulds, as an AO surface and an EP surface shown in FIG. 3, such that when the 45-degree surfaces of the adjacent integrated side moulds are matched in a cold state, V-shaped gaps are formed on the 45-degree matching surfaces of the side moulds, and the clearance of the gaps on the circumference of the inner sides of the side moulds is from 0.2 mm to 0.4 mm.

In one preferred aspect of the present invention, the distance from the point (K) to the point (C) is 0.3 mm, and the distance from the point (L) to the point (H) is 0.2 mm.

In one preferred aspect of the present invention, the clearance of the gaps on the circumference of the inner sides of the side moulds is 0.3 mm in the matching state of the 45-degree matching surfaces of the integrated side moulds.

In one preferred aspect of the present invention, the range of the V-shaped gaps of the 45-degree matching surfaces of the integrated side moulds is set between a point M and a point N as shown in FIG. 3, the point M is a cusp of a 15-degree matching surface of the side mould with the lower mould, and the point N is a point of tangency of a 9-degree slope of an inner wheel rim of a hub with a circular arc.

In another aspect of the present invention, the application of the above-mentioned mould in low-pressure casting of aluminum alloy wheels is further provided.

The thermal deformation circular arc compensation surfaces are formed by processing on the upper and lower one-fourth circular arc matching surfaces of the integrated side moulds by reasonably setting thermal deformation compensation quantity in the key range of the 45-degree matching surfaces of the integrated side moulds according to the thermal deformation compensation technical solution of the mould for low-pressure casting of the wheels provided by the present invention and the thermal deformation rule of the mould on the premise that a casting technology can not be affected, such that the matching surfaces of the integrated side moulds are precisely matched in a hot state.

The technical solutions of the present invention have the following advantageous technical effects:

(1) the thermal deformation compensation surfaces are formed on the upper and lower one-fourth circular arc matching surfaces of the four integrated side moulds, so that the integrated side moulds and the circular arc of the lower mould are matched in a more fit and precise manner;

(2) the stress caused by expansion of the side moulds is reduced and the service life of the mould is prolonged by forming the gaps in the key parts of the 45-degree matching surfaces of the integrated side moulds, and thus, the 45-degree matching surfaces of the side moulds are more fit, and the parting-line flashes are reduced; and (3) the side moulds can effectively solve the problems, such as imprecise matching of the matching surfaces, the parting-line flashes of the matching surfaces and adhesion of aluminum, caused by thermal deformation of the integrated side moulds.

BRIEF DESCRIPTION OF THE DRAWINGS

The embodiments of the present invention are described below in details with the reference to the accompanying drawings, wherein.

DETAILED DESCRIPTION OF THE INVENTION

Embodiment 1: Manufacturing of the Mould

The mould is manufactured by reasonably setting thermal deformation compensation quantity between the side moulds, and among the matching surfaces of the side moulds and the circular arc side surfaces of the lower mould according to the thermal deformation rule of the mould on the premise that the casting technology is not affected.

Figure 1:
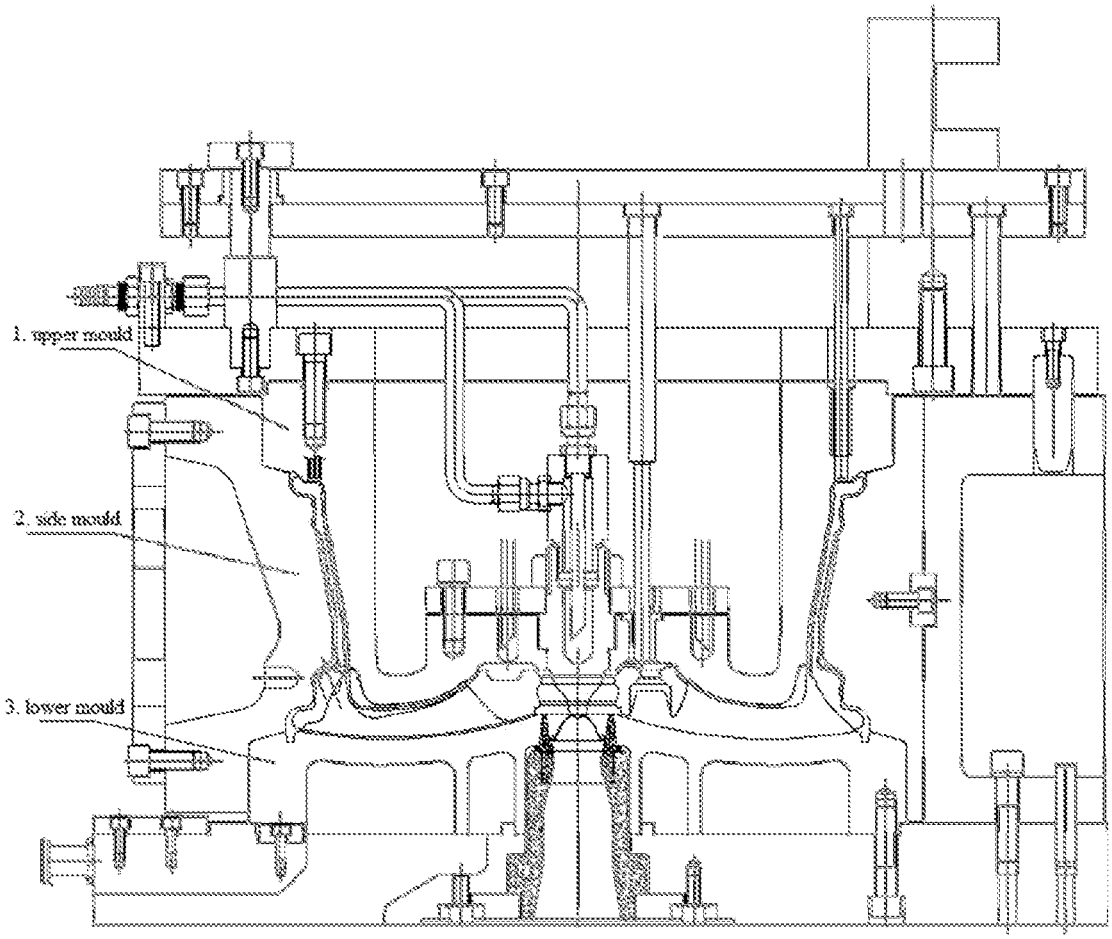
FIG. 1 is a matching form of side moulds of the mould for low-pressure casting of wheels in the prior art, and in FIG. 1, reference numeral 1 represents an upper mould, reference numeral 2 represents a side mould, and reference numeral 3 represents a lower mould.
Figure 2:
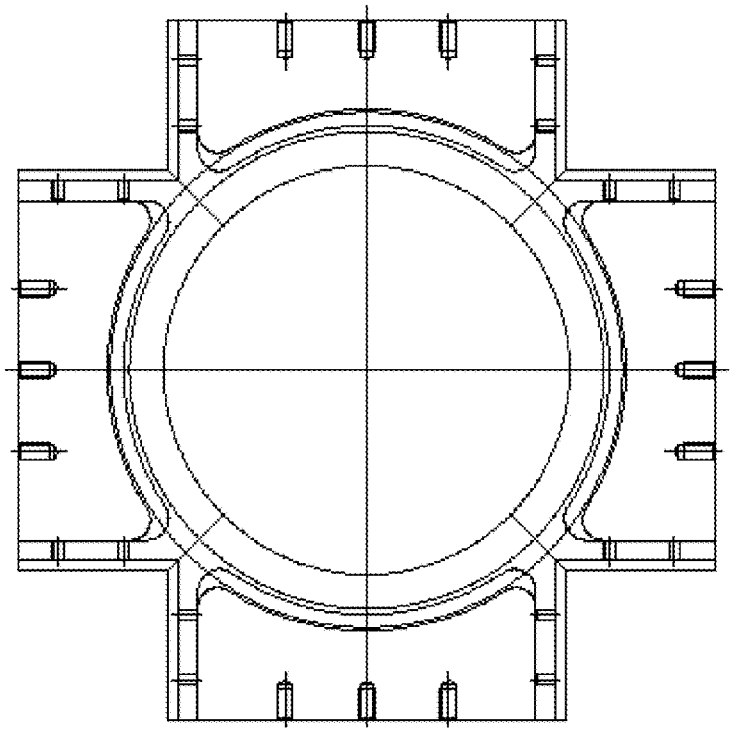
Fig.2 PRIOR ART
FIG. 2 is a schematic diagram of side mould matching in the prior art.
Figure 3:
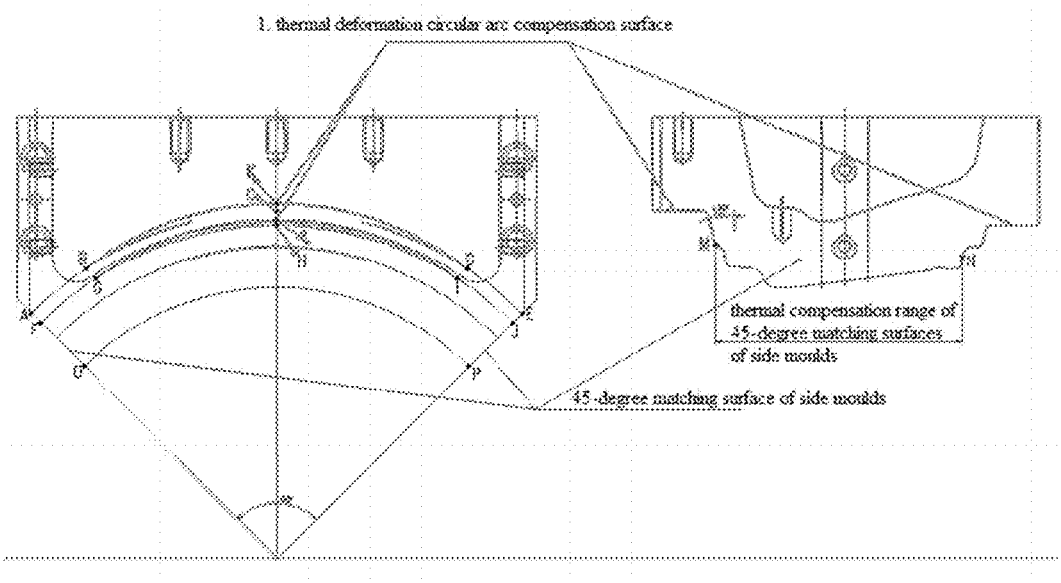
FIG. 3 is a schematic diagram of thermal deformation compensation surfaces of the upper and lower one-fourth circular arc matching surface parts of the integrated side mould of the present invention and thermal compensation of an 45-degree matching surface of the integrated side moulds.
Figure 4:
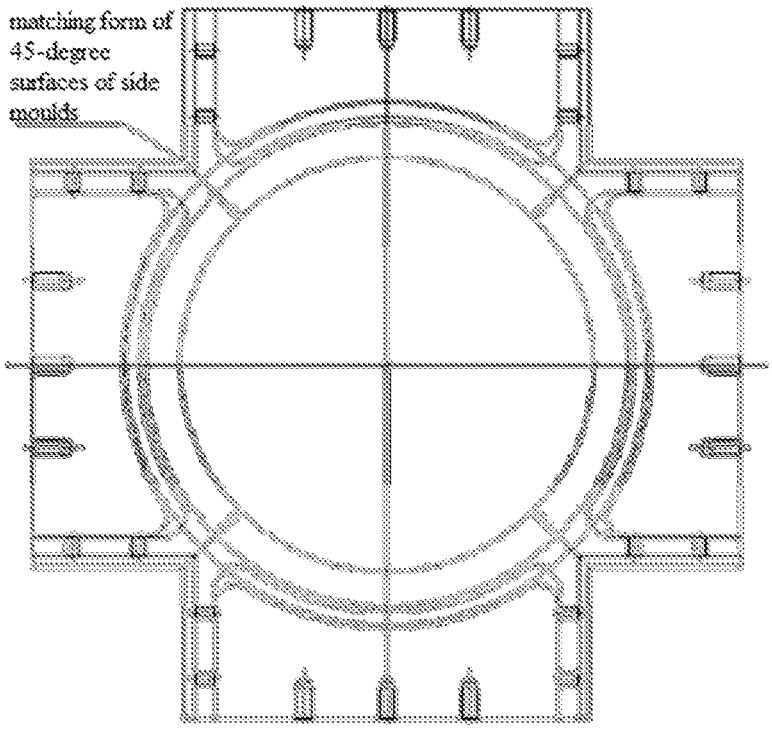
FIG. 4 is a schematic diagram of thermal deformation matching of 45-degree matching surfaces of the integrated side moulds.

I. as shown in FIG. 3, five points A, B, C, D and E lie on a common circle (a circular arc line before modification), and three points B, K and D lie on a common circle, thus forming thermal deformation compensation parts. The distance from the point K to the point C is the longest and is 0.3 mm, and as approaching the points B and C, the two circular arcs are gradually close to each other until they are intersected with each other. The points A, B, E, C and D form a modified circular arc line; and the points B and D are located on the original circular arc, points G and I are located on the original circular arc, and they are 60 mm apart from corresponding 45-degree matching surfaces respectively;

II. as shown in FIG. 3, five points F, G, H, I and J lie on a common circle (a circular arc line before modification), and three points G, L and I lie on a common circle, thus forming the thermal deformation compensation parts. The distance from the point L to the point H is the longest and is 0.2 MM, and as approaching the points G and I, the two circular arcs are gradually close to each other until they are intersected with each other, and the F, G, L, I and J form a modified circular arc line;

III. 0.3 MM of thermal deformation compensation quantity is adopted in the key range of the 45-degree matching surfaces of the integrated side moulds, such that the matching surfaces of the integrated side moulds are precisely matched in a hot state;

IV. programming milling is performed on the B, K and D thermal compensation circular arc surface and the G, L and I thermal compensation circular arc surface which are formed on the one-fourth circular arcs of the integrated side moulds, and after the rotation degrees of the 45-degree surfaces are calculated according to the compensation quantity, the thermal compensation gap parts of the 45-degree matching surfaces of the integrated side moulds are subjected to gradual milling in the range of M and N of the key parts of the 45-degree surfaces.

The above mould is recorded as an experimental group 1, and in addition, moulds are also obtained by manufacturing according to the following parameters:

Experimental group 2: the distance from the point (K) to the point (C) is 0.2 mm; the distance from the point (L) to the point (H) is 0.5 mm, and the clearance of the gaps on the circumference of the inner sides of the side moulds is 0.2 mm; and the points B and D are located on the original circular arc, the points G and I are located on the original circular arc, and they are 60 mm apart from the corresponding 45-degree matching surfaces respectively.

Experimental group 3: the distance from the point (K) to the point (C) is 0.5 mm, the distance from the point (L) to the point (H) is 0.2 mm, and the clearance of the gaps on the circumference of the inner sides of the side moulds is 0.4 mm; and the points B and D are located on the original circular arc, and the points G and I are located on the original circular arc and are 80 mm apart from the corresponding 45-degree matching surfaces respectively.

Experimental group 4: the distance from the point (K) to the point (C) is 0.3 mm, the distance from the point (L) to the point (H) is 0.2 mm, and the clearance of the gaps on the circumference of the inner sides of the side moulds is 0.2 mm; and the points (B) and (D) are located on the original circular arc, and the points (G) and (I) are located on the original circular arc and are 70 mm apart from the corresponding 45-degree matching surfaces respectively.

Control group: a conventional aluminum wheel casting mould with integrated side moulds, the difference between which and the experimental group 1 lies in that conventional aluminum wheel casting mould with the integrated side moulds does not include the thermal deformation compensation parts.

Embodiment 2: Pilot Test

The mould of the experimental group 1 in the embodiment 1 is used for testing of A356 aluminum alloy hub casting under the normal operating conditions of the mould (the temperature of the molten aluminum is 700 degrees Celsius, and the temperature of the mould is maintained in a normal temperature field). The results show that in the casting testing of 5,000 castings, compared with the control group, the mould has the advantages that the proportion of parting-line flashes of the matching surfaces of the castings is decreased from 100% to 2%, and the proportion of adhesion of aluminum is decreased from 65% to 0.3%. Meanwhile, the service life of the mould is tested according to the same method. The test proves that the service life of the mould is prolonged from 30,000 castings to 40,000 castings, and in overall consideration of the loss caused by parting-line flashes, prolonging of the service life of the mould, stability of on-site production take and the like, the casting cost of every 10,000 hubs is saved by RMB 24,700 (approximately USD $3,878).

The experimental groups 2-4 are also tested. The results show that the proportion of the parting-line flashes of the matching surfaces of the castings is all decreased below 5%, the proportion of adhesion of aluminum is all decreased below 0.7%, and the service life of the mould is all prolonged to more than 38,000 castings. The moulds of the above experimental groups greatly reduce the production cost of the hubs and bring good economic and social benefits.

The invention claimed is:

1. An integrated mould for low-pressure casting of wheels, comprising:

an upper mould, integrated air-cooled side moulds and a lower mould, and further comprising:

thermal deformation circular arc compensation surfaces with endpoints of (B), (D), (G) and (I), which pass through points (K) and (L) respectively, are formed by processing on upper and lower one-fourth circular arc matching surfaces of the integrated side moulds, that is on the circular arc surfaces of the integrated side moulds, which are matched with side walls of the upper mould and the lower mould;

the two points, K and L, are located on the thermal deformation circular arc compensation surfaces, the distance from the point (K) to an original circular arc point (C) is from 0.2 mm to 0.5 mm, and the distance from the point (L) to an original circular arc point (H) is from 0.2 mm to 0.5 mm;

the points (B) and (D) are located on an original circular arc of the lower one-fourth circular arc matching surface, the points (G) and (I) are located on an original circular arc of the lower one-fourth circular arc matching surface, and they are 60 to 80 mm apart from corresponding 45-degree matching surfaces respectively;

compensation surfaces are formed by processing on the 45-degree matching surfaces of the adjacent integrated side moulds, such that when the 45-degree surfaces of the adjacent integrated side moulds are matched in a cold state, V-shaped gaps are formed on the 45-degree matching surfaces of the side moulds, and the clearance of the gaps on the circumference of the inner sides of the side moulds is 0.2 mm to 0.4 mm; and the 45-degree surfaces of the integrated side moulds are the matching surfaces of four side moulds.

2. The mould according to claim 1, wherein the distance from the point (K) to the point (C) is 0.3 mm, and the distance from the point (L) to the point (H) is 0.2 mm.

3. The mould according to claim 1, wherein the clearance of the gaps on the circumference of the inner sides of the side moulds is 0.3 mm in the matching state of the 45-degree matching surfaces of the integrated side moulds.

4. The mould according to claim 1, wherein the range of the V-shaped gaps of the 45-degree matching surfaces of the integrated side moulds is set between points (M) and (N), the point (M) is a cusp of a 15-degree matching surface of the side moulds with the lower mould, and the point (N) is a point of tangency of a 9-degree slope of the inner rim of a hub with the circular arc.

* * * * *